US005722328A

United States Patent [19]

Darby

[11] Patent Number: 5,722,328

[45] Date of Patent: Mar. 3, 1998

[54] PALLET SYSTEM INCLUDING SIDE WALL LATCH ASSEMBLY

[75] Inventor: Robert J. Darby, Greensboro, N.C.

[73] Assignee: T.H.E.M. International, Inc., Greensboro, N.C.

[21] Appl. No.: 611,452

[22] Filed: Mar. 5, 1996

Related U.S. Application Data

[63] Continuation-in-part of Ser. No. 471,963, Jun. 6, 1995, abandoned.

[51] Int. Cl.[6] ..... B65D 19/44

[52] U.S. Cl. ..... 108/55.1; 108/53.1; 206/600

[58] Field of Search ..... 108/55.1, 51.1, 108/55.5, 53.3, 53.1, 56.1; 220/4, 32, 315; 206/600

[56] References Cited

U.S. PATENT DOCUMENTS

| | | | |
|---|---|---|---|
| 2,650,737 | 9/1953 | Geyer et al. . | |
| 2,797,727 | 11/1957 | Downing et al. | 229/23 A |
| 2,893,588 | 2/1959 | Martin | 220/4 |
| 3,443,737 | 5/1969 | Kupersmit . | |
| 3,589,548 | 6/1971 | Weiss | 220/4 R |
| 3,664,570 | 5/1972 | Kupersmit | 229/23 R |
| 3,754,803 | 8/1973 | Underwood et al. . | |
| 3,770,186 | 11/1973 | Kupersmit | 229/23 R |
| 3,797,691 | 3/1974 | Williams, Jr. . | |
| 3,804,032 | 4/1974 | Baucom | 108/56.3 |
| 3,828,964 | 8/1974 | Bonnot | 220/1.5 |
| 3,973,684 | 8/1976 | Di Martino . | |
| 3,986,659 | 10/1976 | Vajtay | 229/43 |
| 4,287,997 | 9/1981 | Rolfe et al. . | |
| 4,314,686 | 2/1982 | März . | |
| 4,329,149 | 5/1982 | Kupersmit | 229/45 R |
| 4,445,614 | 5/1984 | Mitsumori et al. | 206/599 |
| 4,453,471 | 6/1984 | Harrington et al. | 108/56.1 |
| 4,503,973 | 3/1985 | Anderson | 206/386 |
| 4,531,670 | 7/1985 | Kupersmit | 229/45 R |
| 4,550,830 | 11/1985 | Shuert | 206/386 |
| 4,615,464 | 10/1986 | Burns | 220/469 |
| 4,643,314 | 2/1987 | Kidd | 206/600 |
| 4,742,781 | 5/1988 | Shuert | 108/53.5 |
| 4,765,252 | 8/1988 | Shuert . | |
| 4,785,957 | 11/1988 | Beck et al. | 220/4 |
| 4,856,657 | 8/1989 | Shuert . | |
| 4,967,927 | 11/1990 | Reiland et al. | 220/337 |
| 4,989,731 | 2/1991 | Shuert | 206/386 |
| 5,029,734 | 7/1991 | Nichols | 222/105 |
| 5,109,985 | 5/1992 | Rose . | |
| 5,123,541 | 6/1992 | Giannini et al. | 206/600 |
| 5,133,460 | 7/1992 | Shuert | 206/600 |
| 5,279,423 | 1/1994 | Shuert | 206/600 |
| 5,358,137 | 10/1994 | Shuert et al. | 220/401 |
| 5,441,154 | 8/1995 | Youell, III . | |

*Primary Examiner*—Jose V. Chen

*Attorney, Agent, or Firm*—Rhodes, Coats & Bennett, L.L.P.

[57] ABSTRACT

A latch mechanism is mounted on a pallet adjacent the peripheral rim thereof. The latch mechanism is selectively transitionable between an engaged position wherein the latch mechanism engages the lock slot thereby securing the side wall to the pallet and a disengaged position wherein the latch mechanism is not engaged with the lock slot thereby allowing the side wall to be removed from the pallet. A fixed bracket is mounted on the pallet adjacent the peripheral rim and spaced apart from the latch mechanism. The fixed bracket is arranged and configured to receive and engage the coupling structure from a first direction. When the fixed bracket and the coupling structure are engaged, the fixed bracket restricts movement of the side wall with respect to the pallet in a second direction.

43 Claims, 8 Drawing Sheets

PALLET SYSTEM INCLUDING SIDE WALL LATCH ASSEMBLY

This is a Continuation-in-Part application of applicant's application Ser. No. 08/471,963, filed Jun. 6, 1995 now abandoned.

FIELD OF THE INVENTION

The present invention is directed to a pallet system of the type for holding and transporting yarn packages and the like, and, more particularly, to a pallet system including a pallet and a side wall detachably secured thereto by a latch assembly.

BACKGROUND OF THE INVENTION

Packaging systems utilizing pallets or support members separated by side walls are commonly used to hold and transport a variety of articles. Such packaging systems are particularly advantageous for packaging textile products such as yarn packages. The side walls serve to protect the yarn or like material from impact, abrasion, and contaminants in the environment, as well as to transfer the load of superimposed pallets to the ground.

To increase the cost-effectiveness of packaging systems utilizing side walls, the side walls are often made of corrugated cardboard or other semi-durable material. Further, it is desirable to minimize the size of return packages, i.e., the shipping space taken up by a given packaging system when reconfigured for return to the supplier. For this reason, packaging systems have been developed wherein the side walls are detachable from the pallet or pallets. To provide a detachable side wall, it is necessary to provide a locking or latching arrangement or system for securing the side wail to the pallet. Many such latching systems have been developed for this purpose, all of which suffer from certain distinct drawbacks.

Several designs provide latching systems which one or more components must be ruptured in order to detach the side walls from the pallet. These designs have a drawback in that they are not reusable.

U.S. Pat. No. 4,765,252 and U.S. Pat. No. 4,856,657, both to Shuert, disclose a reusable plastic base which serves as a pallet which may be lifted by the forks of a forklift truck. A corrugated sleeve is removably attached to the base and forms the side wails of the container. The sleeve includes slots formed along its lower edge and which extend transversely through the sleeve wail, the slots adapted to coact with a latch member slidably mounted in the base to releasably secure the pallet to the sleeve. Packaging systems utilizing the plastic base of the Shuert patents suffer from several drawbacks. First, there is a tendency for the latch members to deflect, thereby allowing the latch member to become dislodged from the slot and the side wall to be lifted from the pallet. Further, access to activate the latch member is necessarily from underneath the pallet. Such access is inconvenient and potentially dangerous for the operator. Further, to provide access to the means for sliding the latch members which can be used when the pallet is on a supporting surface, the access must be provided within the tunnels which receive the forklift forks. As a result, the access means is subject to damage from contact with the forks.

U.S. Pat. No. 5,109,985 to Rose discloses an end cap locking means for a palletized container. The palletized container includes a side wall having a notch adjacent one of its ends and a slide bar slidably retained within the notch for movement between an advanced position and a retracted position. The end cap (cover) includes an outermost wall positionable outside of the side wall when the side wall is received by the end cap. The outermost wall includes a slotted boss protruding generally inwardly from the outermost wall. When the side wall is received by the end cap, the slots in the boss accept the slide bar when it is moved from its retracted position toward its advanced position to thereby lock the side wall defining member to the end cap. The palletized container as disclosed suffers from a significant drawback in that the slide bar is secured to the side wall. Typically, the pallets have a much longer useful life than the corrugated cardboard side walls, such that the side walls are relatively disposable. The slide bars are relatively expensive to manufacture, and the provision of slide bars on the side walls adds substantially to the cost of the side wall component. Further, the slide bars are retained within the notches by staples. For this reason, when the side wall is formed from corrugated cardboard or the like, there is a tendency for the retaining means to tear away from the side wall, making the latch design ineffectual. The palletized container according to the Rose invention requires that the end cap have a particular structure, namely, that it have an outermost wall with an inwardly protruding slotted boss formed therein.

In addition to the above noted concerns, certain other limitations and aspects of removable side wall containers significantly affect the cost effectiveness and usability of such pallet systems. For example, because such containers are often stacked, fully loaded, one or more on top of the other, they must be able to withstand relatively large compressive loads. The feet of the bottom pallet are frequently mangled by impact with forklift skids, making the pallet unusable. Further, it is generally desirable to minimize the overall cost of manufacturing the containers. Significant costs are incurred in the production and maintenance of tooling for forming the various molded parts. Each unique part requires additional tooling, adding to the overall expense in forming the containers.

In certain applications, the relation between the heights of the side walls and the lengths of the pallets severely limits the number of packages which may be carried and/or the size of the return package. For example, in order to return a pallet system in its least space consuming configuration, the side wails are often folded and placed in and between the top and bottom pallets. In order to do this, the heights of the side walls must be no longer than interior lengths of the pallets. In many industries, pallets are often made in standardized sizes having prescribed lengths. In turn, the maximum height of the side walls is limited. Often, the number of packages which may be fit in a container could be significantly increased if the distance between the lower support surface of the top pallet and the upper support surface of the bottom pallet of a given container were increased a small amount, for example, on the order of about ½–2 inches. In conventional pallet systems, the surfaces which support the side walls are generally at or below the support surfaces of the pallets, that is, the distance between the sidewall support surfaces is greater than the distance between the opposed package support surfaces. Thus, the maximum distance between the opposed top and bottom package support surfaces can be no greater than the lengths of the pallets if a compact return configuration is to be achieved.

Thus, there exists a need for a packaging system which provides for a pallet and side wall assembly wherein the side wall is conveniently attachable and detachable from the pallet. Further, there exists a need for such a packaging system which is cost-effective to manufacture and use. There exists a need for a packaging system as described above which is durable and sturdy. Moreover, there exists a need for a packaging system as disclosed above which provides safe and convenient access to means for securing the side wall to the pallet.

SUMMARY OF THE INVENTION

The present invention is directed first of all to an improved latch mechanism for releasably securing the lower upper edge of a side wall to a pallet. The pallet includes a peripheral rim which extends along at least one side of the pallet and contains a latch mechanism, and the side wall includes a latch plate. The latch mechanism includes a latch mounting member and a latch member. The latch mounting member is secured to the aforesaid peripheral rim of the pallet. The latch member includes a body portion having a finger and protruding longitudinally from one end and is slidably mounted on the latch mounting member for reciprocal movement along the peripheral rim. The latch member may be selectively slid between an engaged position and a non-engaged position. When the latch member is in the engaged position, the finger is engaged with the latch plate of the side wall, thereby securing the side wall to the pallet. When the latch member is in the non-engaged position, the finger is not engaged with the latch plate, thereby allowing the side wall to be removed from the pallet.

The latch member may include a slot formed therein. A pin extends outwardly from the peripheral rim of the pallet and into the slot. The latch member may further include lock means operative to maintain the latch member in the engaged and/or non-engaged position. The lock means may be, for example, at least one resilient tab operative to releasably restrict movement between the pin and the latch member.

The above-noted latch plate preferably includes a substantially rigid body structure having at least one support wall and a bottom wall. A securement structure is associated with an upper portion of the support wall and is operative to mount the latch plate on the side wall. The bottom wall cooperates with the latch member to prevent removal of the side wall. The support wall and the bottom wall define a chamber arranged and configured to receive the finger portion of the latch member as it is moved in a direction substantially parallel to the length of the peripheral edge of the side wall.

The securement structure may include a projection extending from the upper portion of the support wall. The projection may be adapted to engage a hole formed in the side wall.

The present invention is further directed to a latch assembly for securing a side wall to a pallet as discussed above which includes both the aforedescribed latch mechanism and the aforedescribed latch plate. More particularly, when the latch member is in the engaged position as discussed above, the finger is removed from the chamber of the latch plate, thereby securing the side wall to the pallet. When the latch member is in the non-engaged position as discussed above, the finger is removed from the chamber of the latch plate, thereby allowing the side wall to be removed from the pallet.

The present invention is further directed to various other unique structures and aspects for overcoming certain deficiencies and obstacles including those as set forth in the Background of the Invention. These features may be applied in various combinations and subcombinations as well as apart from one another. Each of the features or structures are described below.

The present invention is also directed to a second type of latch mechanism for releasably securing a side wall of a container to a pallet, the pallet being of a type having a peripheral rim extending along a side of the pallet, the peripheral rim having an upper surface and a lower surface, a longitudinal slot formed through and along the peripheral rim, the side wall including a locking slot along a lower edge. The latch mechanism includes a latch member. The latch member includes a connector extending through the longitudinal slot. The connector has a first end adjacent the upper surface of the peripheral rim and a second end adjacent the lower surface of the peripheral rim. A finger is mounted on the first end of the connector. At least one control tab depends from the second end of the connector. The latch member is slidably mounted in the longitudinal slot for reciprocal movement along the peripheral rim and between an engaged position and a non-engaged position. When the latch member is in the engaged position, the finger is engaged with the locking slot of the side wall thereby securing the side wall to the pallet, and, when the latch member is in the non-engaged position, the finger is not engaged with the locking slot thereby allowing the side wall to be removed from the pallet.

The latch mechanism as just described may further include a flexible base member secured to the second end, the base member selectively deflectable between a locked position and a released position by means of the tab. When the base member is in the released position, the latch member may be transitioned between the engaged and non-engaged positions and, when the base member is in the locked position, the latch member is restricted from transition between the engaged and non-engaged positions.

A second control tab may depend from the second end. In such case, the base member may be transitioned between the locked and released positions by moving at least one of the first and second control tabs toward the other.

The base member may include an upper surface adjacent the lower surface of the peripheral rim and an extension extending upwardly from the upper surface of the base member. At least a portion of the extension is disposed within a recess formed in the peripheral rim when the latch member is in the engaged position and the base member is in the locked position. The extension is not disposed in the recess when the base member is in the released position.

The present invention is further directed to a fixed bracket for use in conjunction with a pallet and a side wall having a lower edge and a coupling structure each adjacent the lower edge, the pallet including a peripheral rim arranged and configured to receive the lower edge of the side wall. The fixed bracket is mounted on the pallet adjacent the peripheral rim and is arranged and configured to receive and engage the coupling structure from a first direction when the lower edge is mounted on the peripheral rim. When the fixed bracket and the coupling structure are engaged, the fixed bracket restricts movement of the side wall with respect to the pallet in a second direction. Where the peripheral rim includes a bottom wall, the fixed bracket may include a substantially rigid extension spaced from and extending along the bottom wall. When the fixed bracket and the coupling structure are engaged, at least a portion of the coupling structure is disposed between the extension of the fixed bracket and the bottom wall of the peripheral rim.

The present invention is also directed to a coupling structure for securing a side wall having a lower edge to a pallet. The coupling structure includes a substantially rigid body portion having at least one support wall with an upper portion and a lower portion, the lower portion supporting a hook. A securement structure is associated with the upper portion of the support wall for attaching the hook structure to the side wall. The hook is spaced from and extends along the lower edge when the hook structure is mounted on the side wall.

Further, the lower portion of the aforedescribed coupling structure may include first and second opposed ends, the hook formed on the first end. A chamber is defined in the second end and opens along the lower edge when the coupling structure is mounted on the side wall, whereby the chamber may receive a latch member when the side wall is mounted on the pallet.

The present invention is further directed to a second type of pallet for storing and transporting at least one package and for use with a side wall having a prescribed height and a lower edge. The second type of pallet includes a support surface for supporting the at least one package. A peripheral rim is formed adjacent the support surface and has a bottom wall arranged and configured to support the lower edge of the side wall. The bottom wail is raised with respect to the support surface.

The present invention is further directed to a pallet having an upper surface and a lower surface wherein at least one leg is detachably secured to the lower surface for supporting the pallet.

The present invention is further directed to a side wall including a lower edge, a lock slot, and a coupling structure. The lock slot and the coupling structure are each adjacent the lower edge. The coupling structure is preferably as described above. Further, the side wall preferably includes a first panel, a second panel, and a corner panel connecting the first and second panels. The lock slot may be disposed in the first panel and the coupling structure may be mounted on the second panel. Further, the first and second panels may each include a lower edge, and a cut-out formed in each of the lower edges of the first and second panels.

The present invention is further directed to a pallet for storing and transporting at least one package and for use in conjunction with a side wail having a lower edge and a coupling structure adjacent the lower edge. The pallet includes a peripheral rim arranged and configured to receive the lower edge of the side wall. The pallet further includes a fixed bracket as described above. The peripheral rim may include a bottom wall, such that, when the fixed bracket and the coupling structure are engaged, at least a portion of the coupling structure is disposed between the extension of the fixed bracket and the bottom wall of the peripheral rim.

The present invention is further directed to a pallet as described above further including a fixed bracket as discussed above and a latch mechanism mounted on the pallet adjacent the peripheral rim. The latch mechanism is selectively transitionable between an engaged position wherein, when the lower edge of the side wall is mounted on the peripheral rim, the latch mechanism engages the lock slot thereby securing the side wall to the pallet and a disengaged position wherein the latch mechanism is not engaged with the lock slot thereby allowing the side wall to be removed from the pallet.

The latch mechanism may include a latch mounting member secured to an accessible portion of the peripheral rim of the pallet. A latch member having a finger is provided, the latch member slidably mounted on the latch mounting member for reciprocal movement longitudinally along the peripheral rim. When the latch mechanism is in the engaged position and the lower edge is mounted on the peripheral rim, the finger is engaged with the locking slot, and, when the latch mechanism is in the non-engaged position, the finger is not engaged with the locking slot.

Alternatively, the latch mechanism may include a longitudinal slot formed through and along the peripheral rim and a latch member. The latch member includes a connector extending through the longitudinal slot, the connector having a first end adjacent an upper surface of the peripheral rim and a second end adjacent a lower surface of the peripheral rim. A finger is mounted on the first end of the connector. At least one control tab depends from the second end of the connector. The latch member is slidably mounted in the longitudinal slot for reciprocal movement along the peripheral rim. When the latch mechanism is in the engaged position and the lower edge is mounted on the peripheral rim, the finger is engaged with the locking slot thereby securing the side wall to the pallet, and, when the latch member is in the non-engaged position, the finger is not engaged with the locking slot thereby allowing the side wall to be removed from the pallet. The latch member may include a flexible base member as discussed hereinabove. Further, the latch mechanism may include a second control tab as described hereinabove.

Preferably, the base member of the latch mechanism as just described includes an upper surface adjacent the lower surface of the peripheral rim and an extension extending upwardly from the upper surface of the base member, wherein at least a portion of the extension is disposed within a recess formed in the peripheral rim when the latch mechanism is in the engaged position and the base member is in the locked position, and wherein the extension is not disposed in the recess when the base member is in the released position.

The peripheral rim of the pallet may include a bottom wall such that, when the fixed bracket and the coupling structure are engaged, at least a portion of the coupling structure is disposed between the extension of the fixed bracket and the bottom wall of the peripheral rim.

The pallet may include detachable feet depending from the pallet. The pallet may include a support surface with the peripheral rim formed adjacent the support surface and having a bottom wall arranged and configured to support the lower edge of the side wall, the bottom wall being raised with respect to the support surface.

The present invention is further directed to a pallet system including a side wall as described above as well as a pallet as described above having a latch mechanism and a fixed bracket. The present invention is further directed to a pallet system including a pallet, a side wall, a latch mechanism, and a latch plate and/or a coupling structure as described above.

An object of the present invention is to provide an improved packaging system of the type including a pallet and a side wall and in which there is provided a unique latch mechanism and/or a unique latch plate.

A further object of the present invention is to provide a packaging system as described above wherein the side wall may be easily attached to the pallet, locked thereto, and removed therefrom.

Another object of the present invention is to provide a packaging system as described above which is cost-effective to use and manufacture.

Moreover, it is an object of the present invention to provide a packaging system as described above which is durable and sturdy.

Yet another object of the present invention is to provide a packaging system as described above wherein the mechanism for attaching and detaching the pallet and side wall is easily accessible by a user and resists separation of the side wall and pallet due to lateral and upward forces on the side wall.

BRIEF DESCRIPTION OF THE DRAWINGS

Other objects and a fuller understanding of the invention will become apparent upon reading the following detailed description of a preferred embodiment, along with the accompanying drawings in which.

DETAILED DESCRIPTION OF THE PREFERRED EMBODIMENT

In the following description, it is to be understood that such terms as "forward", "rearward", "left", "leftward", "right", "rightward", "downwardly", and "upwardly", and the like are words of convenience and are not to be construed as limiting terms.

Figure 1:
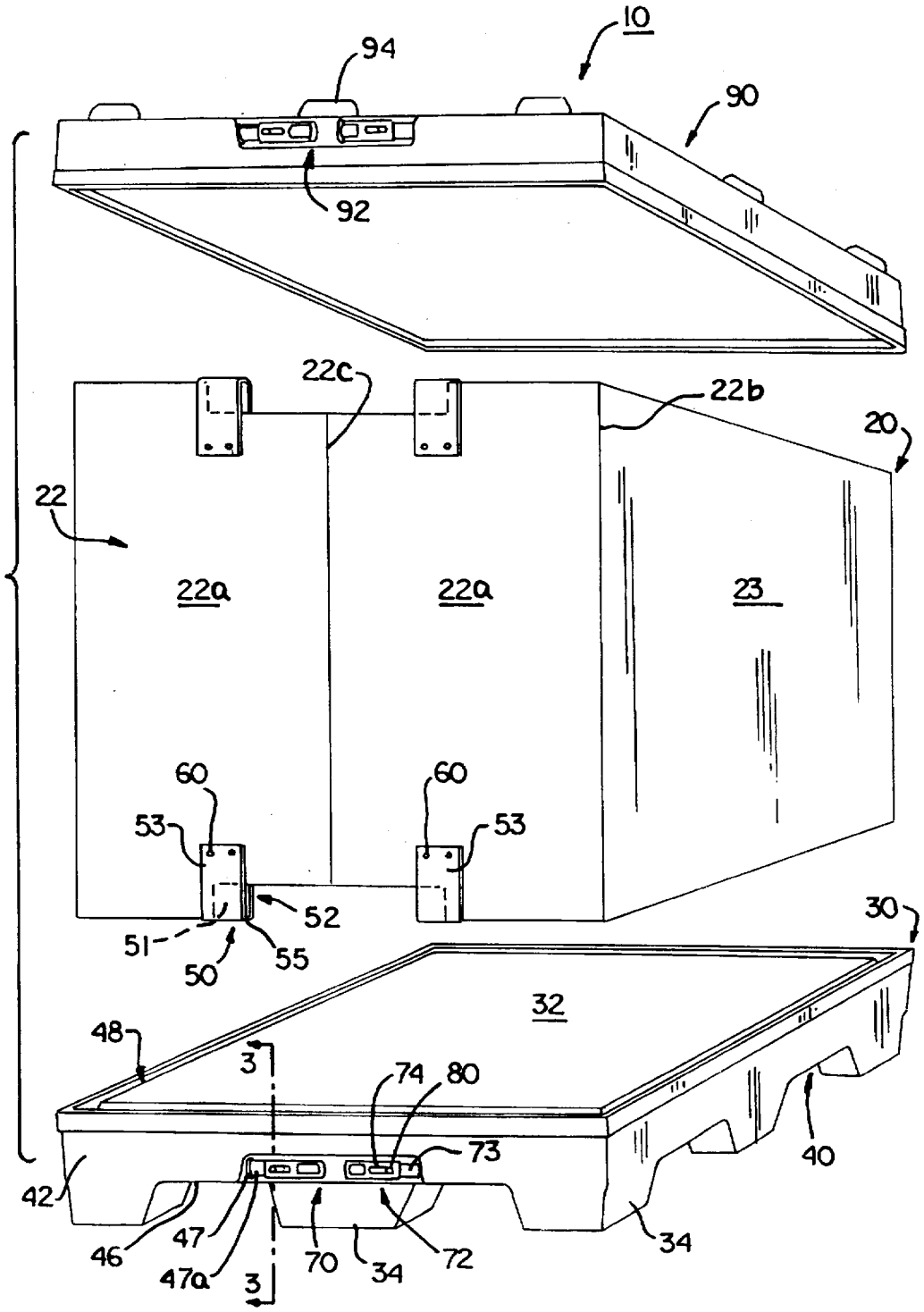
FIG. 1 is an exploded, perspective view of a pallet system according to the present invention.

With reference to FIG. 1, a pallet system according to the present invention, generally denoted by the numeral 10, is shown therein. Pallet system 10 includes side wall component 20, pallet 30 and, optionally, second pallet 90 mounted on side wall component 20 opposite pallet 30. Side wall component 20 includes side walls 22,23. Side wall 22 has a cutout 24 formed in a peripheral edge 26 thereof. Latch plates 50 are mounted on either side of cutout 24. Pallet 30 includes peripheral rim 40 in or on which latch mechanism 70 is mounted. Peripheral rim 40 is adapted to receive peripheral edges 26 of side wall 22 such that cutout 24 surrounds latch mechanism 70 on three sides thereof. Latch mechanism 70 includes latch members 72 which are adapted for sliding, reciprocal movement along peripheral rim 40 for selective engagement and disengagement with respective latch plates 50. In this manner, as set forth in more detail below, latch mechanism 70 and latch plate 50 are accessible from the side and operative to easily and securely lock or couple side wall component 20 and pallet 30, and to thereby allow for non-destructive relative detachment and reattachment of side walls 20 to pallet 30.

Top pallet 90 includes latch mechanism 92 corresponding to latch mechanism 70 of pallet 30, as discussed in more detail below. The side walls may be secured to top pallet 90 in the same manner as they are secured to pallet 30. Top pallet 90 is preferably provided with small feet or nodes 94 which conserve space when a second container is stacked thereon. It will be appreciated that a top pallet identical to pallet 30 may be used as well.

Figure 3:
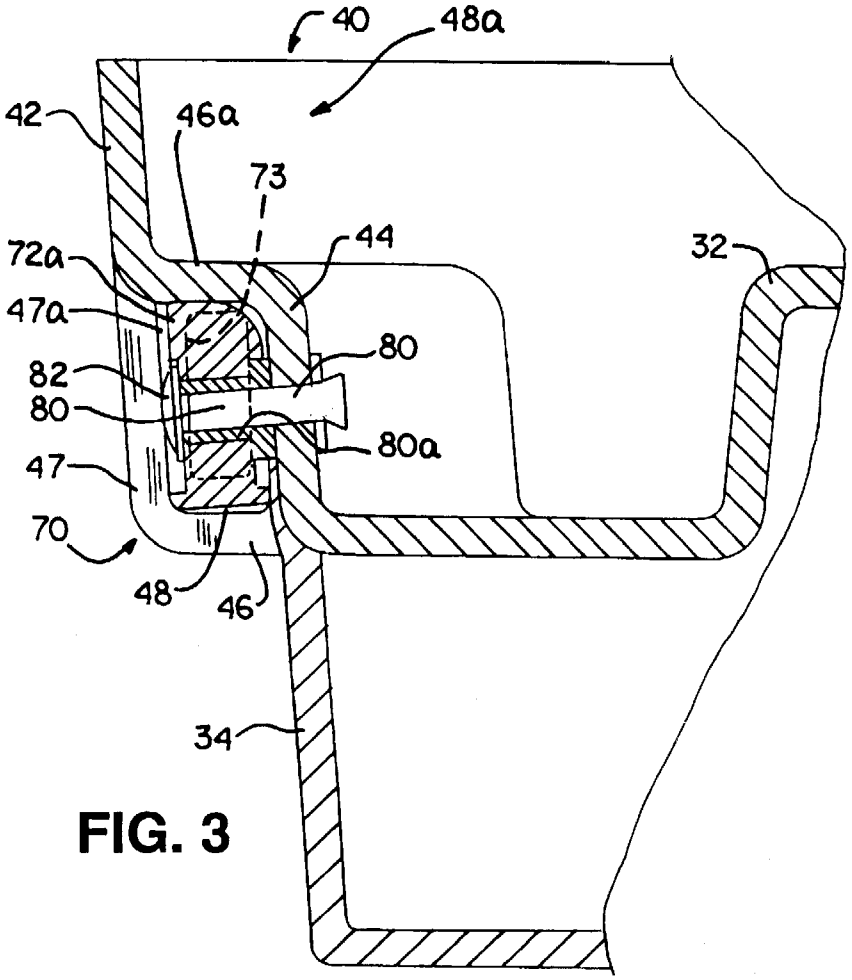
FIG. 3 is a side cross-sectional view of the pallet of the present invention taken along the line 3—3.
Figure 6:
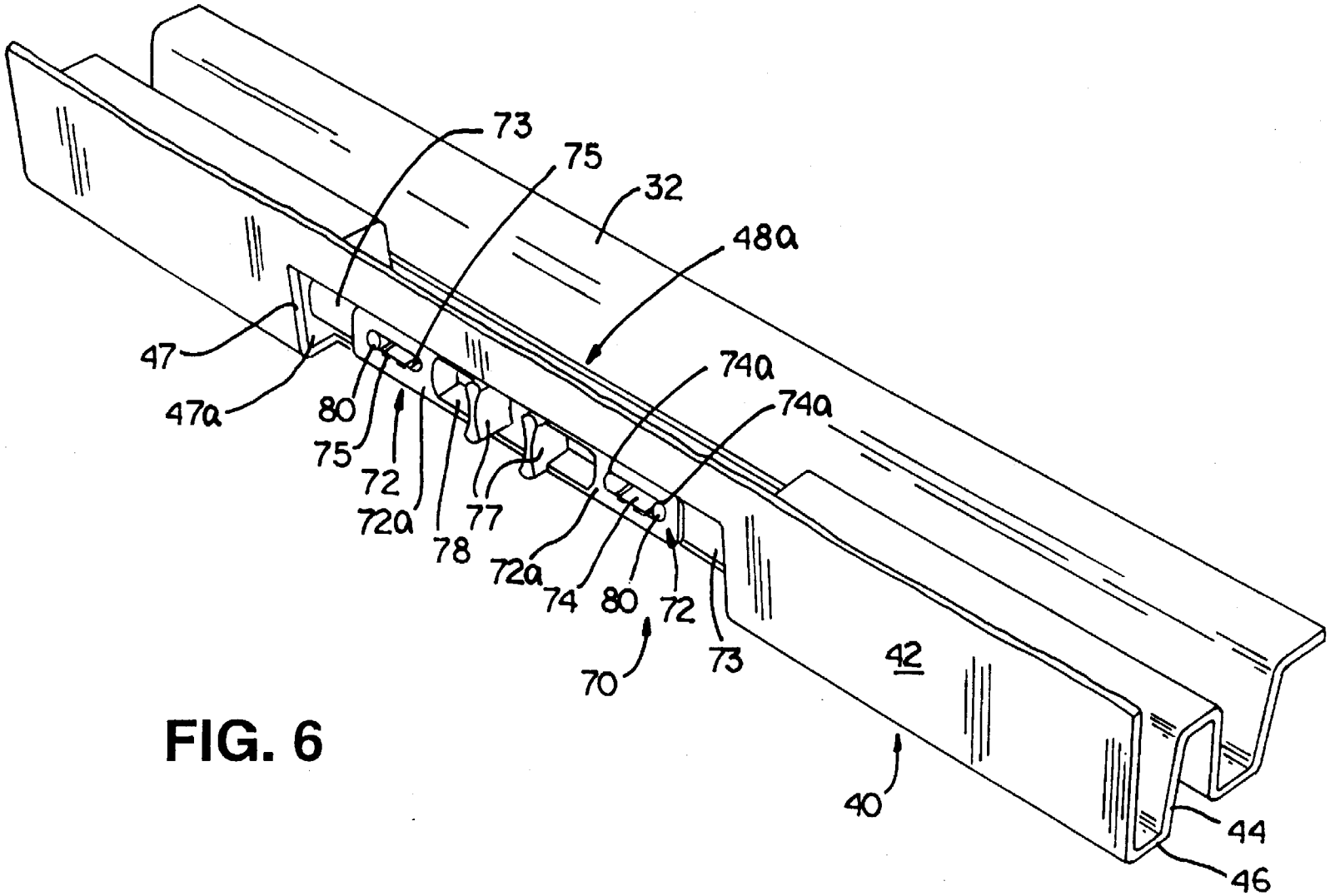
FIG. 6 is a fragmentary, perspective view of a portion of the pallet showing the latch mechanism.

As best seen in FIGS. 1, 3, and 6, pallet 30 includes support face 32 and downwardly depending feet 34. Peripheral rim 40 extends outwardly from support face 32 and continuously surrounds support face 32. Peripheral rim 40 includes outer wall 42, inner wall 44, and bottom wall 46. Walls 42, 44, 46 define groove 48.

Substantially vertical transverse walls 47 extend between outer wall 42 and inner wall 44 on either side of latch mechanism 70. Apertures 47*a* are formed in respective transverse walls 47 and are of such size and shape as to receive fingers 73 as discussed below without interference. Raised portion 46*a* of bottom wall 46 extends between transverse walls 47 and over latch mechanism 70. Raised portion 48*a* of groove 48 likewise extends between transverse walls 47 and over latch mechanism 70, and is defined by outer wall 42, inner wall 44, and bottom wall portion 46*a*.

Figure 4:
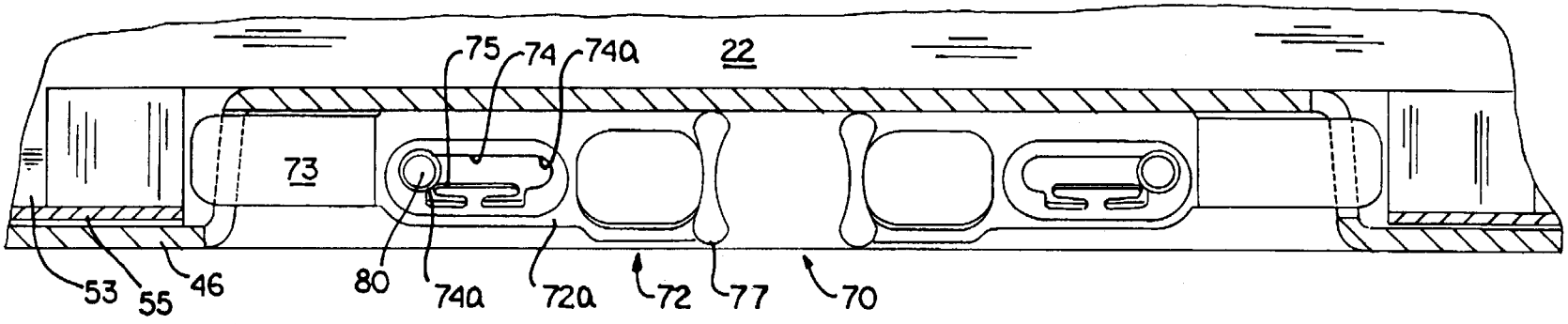
FIG. 4 is a fragmentary, front cross-sectional view of the pallet wherein the latch assembly is in the non-engaged position.
Figure 5:
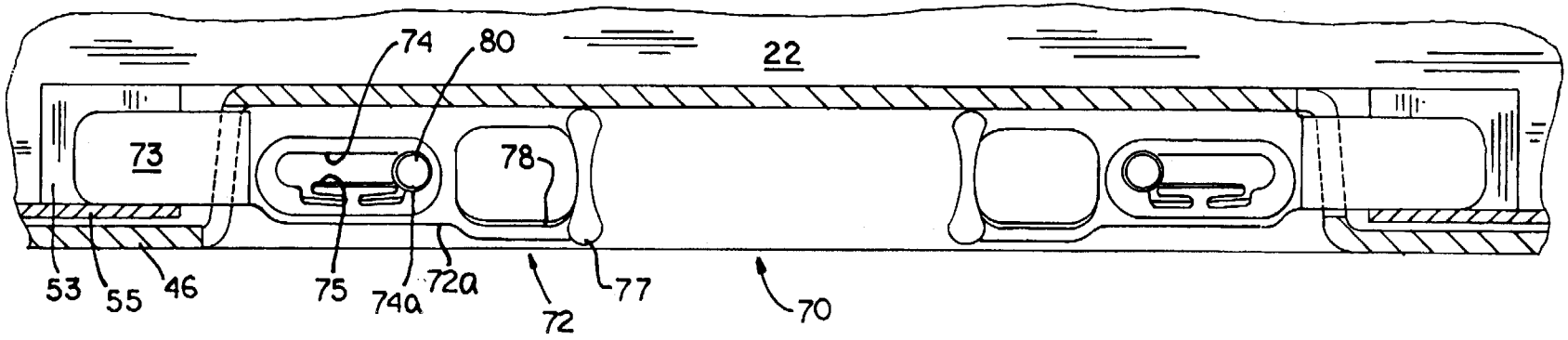
FIG. 5 is a fragmentary, front cross-sectional view of the pallet wherein the latch assembly is in the engaged position.

As best seen in FIGS. 4 and 5, latch mechanism 70 is disposed within the recess defined by transverse walls 47, inner wall 44, and the bottom surface of portion 46*a*. Latch mechanism 70 includes a pair of latch members 72. Each latch member 72 includes a body portion in 72*a*, a finger 73 extending longitudinally therefrom, and a slot 74 formed therein. Each latch member 72 further includes an operator pull 77 projecting outwardly therefrom and an operator hole 78 formed therein. Each of the operator pulls 77 and operator holes 78 are sized and shaped for comfortable and convenient manipulation by an operator's fingers.

As best seen in FIG. 3, latch mechanism 70 further includes pins 80 fixedly and stationarily secured to inner wall 44 and extending outwardly therefrom. Each pin 80 extends through a respective slot 74 and includes a head 82 which serves to retain the respective latch member 72 thereon. Bushing 80*a* is provided to space the latch member from inner wall 44 and to provide an appropriate fit between the pin and recesses 74*a* as discussed below.

With particular reference to FIGS. 4 and 5, slots 74 each include locator recesses 74*a* formed at either end thereof. Locator recesses 74*a* are sized and shaped to receive the diameter of bushings 80*a*. Resilient tabs 75 are disposed within slots 74 and are operative to resist displacement of each latch member 72 when the associated pin 80 is positioned in one of the locator recesses 74*a*.

Figure 2:
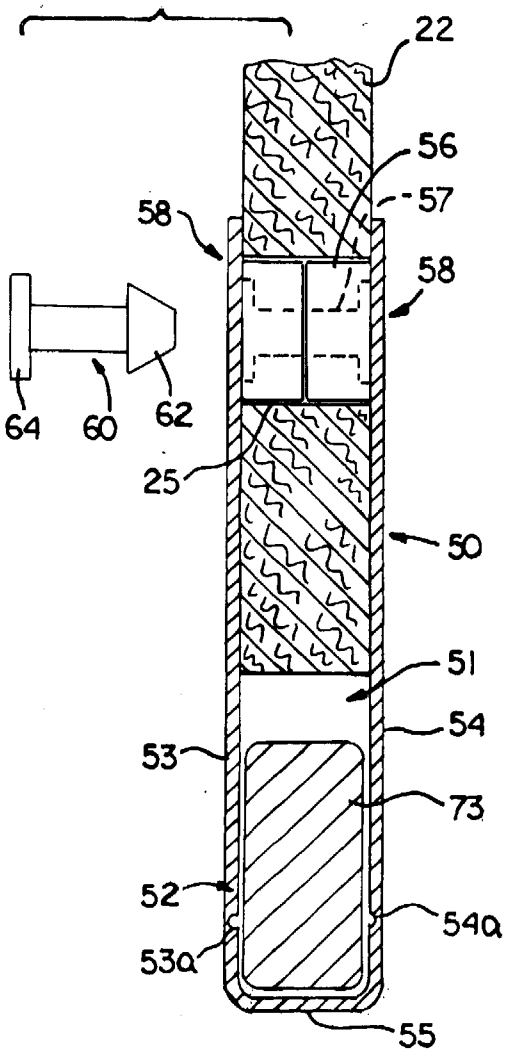
FIG. 2 is an exploded, fragmentary, cross-sectional view of the side wall and the latch plate forming a part of the pallet system according to the present invention, wherein a portion of the latch member is disposed within the latch plate.

As best seen in FIG. 2, latch plate 50 includes outer wall 53, inner wall 54 and bottom wall 55. Walls 53, 54, 55 are preferably joined by living hinges 53*a*,54*a*. Hinges 53*a*,54*a* are preferably spaced from bottom wall 55 as shown. The side edges of walls 53, 54, 55 define opening 52. With reference to FIG. 1, walls 53, 54, 55 along with the top and respective side edge of cutout 24 of side wall 22 define chamber 51. Again with reference to FIG. 2, tubular projections 56 extend inwardly from walls 53, 54, and define channel 57 formed therethrough. Channel 57 terminates in openings 58 formed in walls 53, 54. As best seen in FIG. 1, projections 56 are adapted to fit within holes 25 formed in side wall 22. Christmas tree-type connector 60 is provided to hold projections 56 together, thereby retaining projections 56 in hole 25. Conventional connector 60 includes arrowhead 62 and end cap 64.

Latch plate 50 may, alternatively, include only an outer wall or an inner wall from which a bottom wall extends.

Side walls 22,23 are preferably formed from corrugated, double wall or triple wall cardboard. Corrugated plastic may be used, as well. However, any suitable material may be used.

Pallets 30,90 may be formed from thermoplastic resin, such as polycarbonate or polyethylene, by injection molding or vacuum forming, or from glass reinforced thermoset resin by compression molding. Pallets 30,90 may be of single or double wall construction.

Latch plate 50 is preferably formed from polypropylene by injection molding.

Latch member 72 is preferably formed from polyethylene by injection molding. Pin 80, preferably a pop rivet, may be formed from steel or aluminum. Pin 80 may be joined to pallet 30 by a riveting operation.

With reference to FIGS. 4 and 5, side walls 22 may be secured to and released from pallet 30 in the following manner. It will be appreciated that the following procedure applies to pallet 90 as well. In order to mount side wall component 20 on pallet 30, latch members 72 are first placed in a non-engaged position as shown in FIG. 4. In the non-engaged position, latch members 72 are slid inwardly until pins 80 are positioned in locator recesses 74*a*. When latch members 72 are in this position, fingers 73 will be entirely disposed beneath portion 46*a* of bottom wall 46. Next, side walls 72 are inserted into groove 48 such that latch mechanism 70 is received by cutout 24. In this position, bottom walls 55 of latch plates 50 abut bottom walls 46 of peripheral rim 40 of pallet 30. Further, respective openings 52 of latch plates 50 open toward adjacent apertures 47*a*.

Once peripheral edges 26 of side walls 22 are located in groove 48 as described above, side walls 22 may be secured to pallet 30 by placing latch mechanism 70 in an engaged position as shown in FIG. 5. The engaged position is attained by sliding each of latch members 72 outwardly (i.e., away from each other and along the length of peripheral rim 40) until pins 80 locate in locator recesses 74*a* as shown. In the engaged position, fingers 73 extend through apertures 47*a* and transverse walls 47, and into respective chambers 51 defined by latch plates 50 and the peripheral edges of cutout 24. In order to remove side walls 22 from pallet 30, latch mechanism 70 is again placed in the non-engaged position as shown in FIG. 4. Side walls 22 may then be removed from peripheral rim 40.

It will be appreciated from the foregoing that, when side walls 22 and latch plate 50 are disposed within groove 48 as shown and latch mechanism 70 is in the non-engaged position, side walls 22 may be easily removed from pallet 30 without requiring destruction to the side walls, the pallet, or the attachment means. It will be further appreciated that, when side walls 22 and latch plates 50 are disposed within groove 50 as described and latch mechanism 70 is in the engaged position, removal of side walls 22 from pallet 30 is prohibited. Further, because the construction as described above lends itself to the use of fingers which are vertically relatively wide, latch mechanism 70 will resist relatively great upward forces. Moreover, the design of receiving structure 50 allows for the location of tubular projections 56 at a substantial distance from peripheral edge 26, providing a relatively long tear zone to resist catastrophic failure of the attachment means. The provision of lock tabs 75 substantially reduces any tendency for latch members 72 to unintentionally assume the engaged or non-engaged position.

It will be appreciated that peripheral rim 40 may be formed without outer wall 42 and/or without inner wall 44, or with an outer wall and/or an inner wall which only extends about a portion or portions of the pallet.

If pallet 30 is formed without outer wall 42 on the side including the latch mechanism and side walls 22,23 are formed in a multipanel configuration (i.e., two or more panels joined by a fold or folds), then a container having swingable doors is provided. As shown, side wall 22 comprises a pair of subpanels 22*a* separated by split 22*c* and pivotable about folds 22*b*. When latch mechanism 70 is in the engaged position, side wall component 20 is secured to pallet 30 as described above. However, when either or both of latch members 72 are in the non-engaged position, the corresponding subpanel or subpanels 22*a*, being free of the latch mechanism and unrestrained by an outer wall, are free to swing outwardly about folds 22*b*. It will be appreciated that the same may be accomplished if a top pallet is provided if the top pallet is also formed without an outer wall. Folds 22*b* may be replaced with hinges, for example.

Side walls 22 may be provided with an integrally formed chamber or lip for receiving finger 73, rather than latch plates 50.

It will be appreciated by those of skill in the art that certain modifications may be made to the above described pallet system without departing from the scope of the present invention. For example, the side wall adjacent the latch mechanism may be a single, continuous wall, in which case only a single latch plate and latch member need be associated with the side wall. Moreover, the side wall component could be formed as a continuous tube (i.e., each side wall continuous and joined to the adjacent side walls). In this case, a single latch member and latch plate combination on each of two opposed walls is sufficient to secure the side wall component to each pallet.

With reference to FIGS. 7–13, a pallet system 100 according to a second embodiment of the present invention is shown therein. Pallet system 100 includes side walls 120, bottom pallet 130 and, optionally, top pallet 110 mounted on side wall component 120 opposite bottom pallet 130. Pallets 110 and 130 are releasably secured to side walls 120 by the combination of active latch mechanisms 150 and passive restraint assemblies 170.

Figure 9:
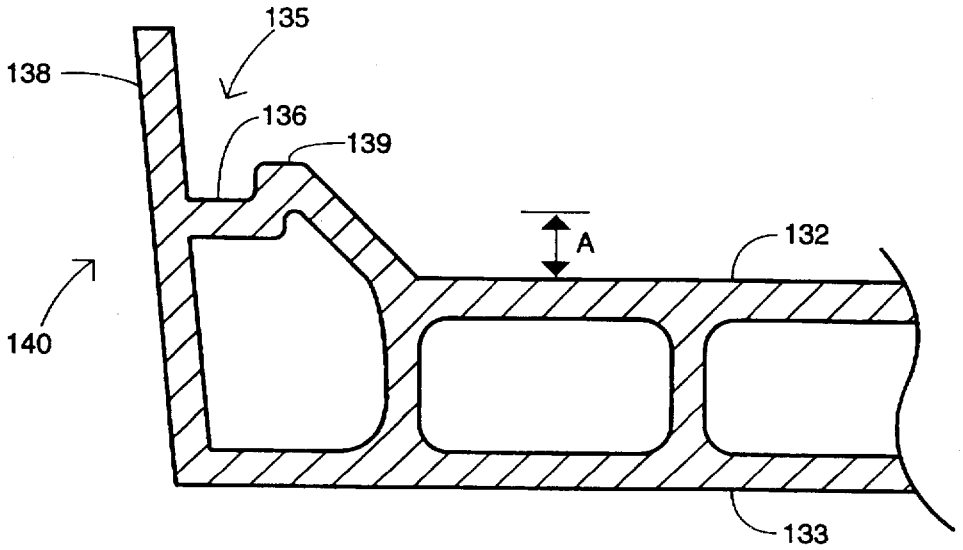
FIG. 9 is a side cross sectional view of the bottom pallet according to the second embodiment taken along the line 9—9 of FIG. 7.

Bottom pallet 130 includes support face 132 and downwardly depending feet 134. Peripheral rim 140 extends outwardly from support face 132 and continuously surrounds 132. With reference to FIG. 9, peripheral rim 140 includes outer wall 138, inner wall 139, and groove 135 having bottom wall 136. Feet 134 are preferably formed as lengthwise extending rails and are secured to bottom pallet 130 by bolts or rivets 134*a* or other suitable means. Peripheral rim 140 includes recesses 137 formed on opposed ends thereof into which latch mechanisms 150 (discussed in greater detail below) are mounted. Further, fixed brackets 180 are mounted in groove 135 on opposed sides of the pallet.

Top pallet 110 is preferably the exact same as bottom pallet 130 except that there is no provision corresponding to feet 134, fixed brackets 180, or securing bolts 134A. Accordingly, it will be appreciated that the discussion of bottom pallet 130 and the associated structures and methods apply equally to top pallet 110.

Figure 7:
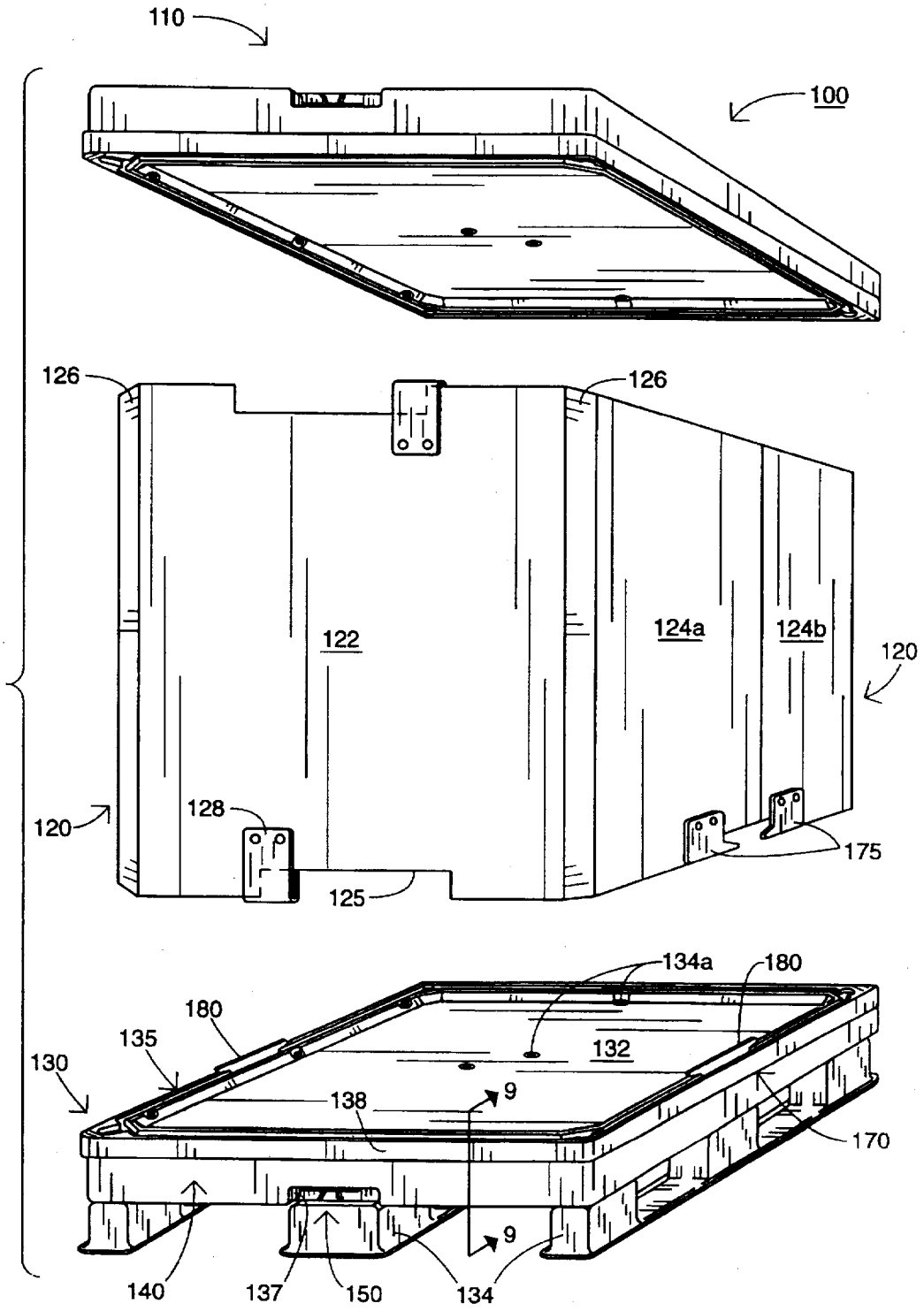
FIG. 7 is an exploded, perspective view of a pallet system according to a second embodiment of the present invention.
Figure 10:
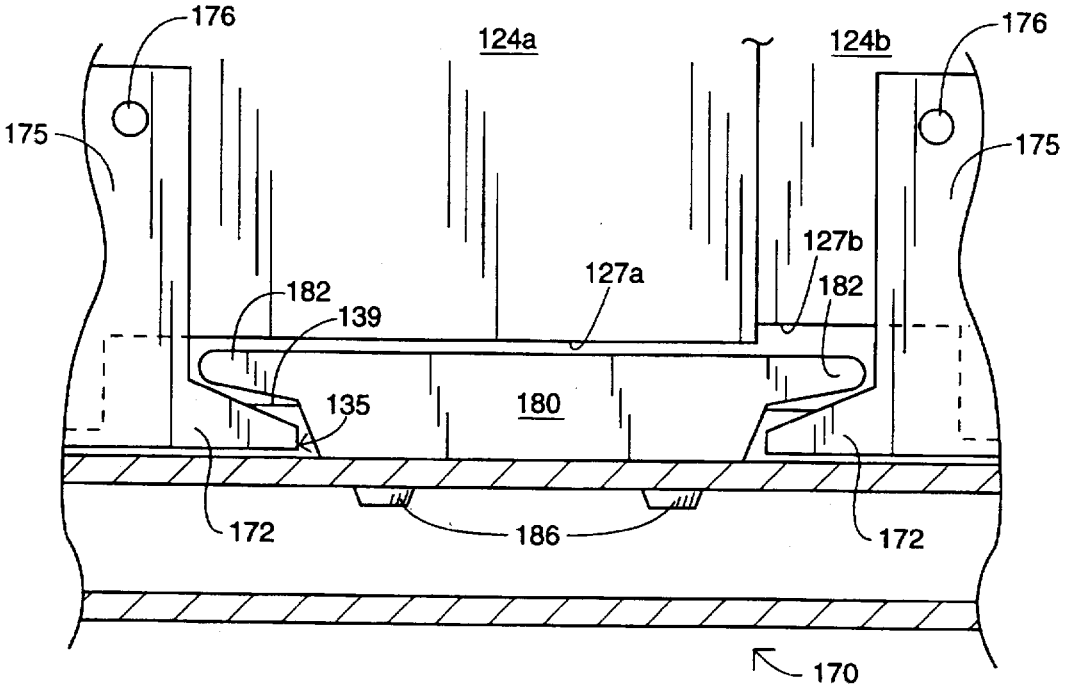
FIG. 10 is a fragmentary, front cross sectional view of the bottom pallet showing the passive restraint assembly.

Two sidewalls 120 are provided, each generally C-shaped and together forming a continuous surrounding wall when mounted in groove 135. Side walls 120 each include an end panel 122, a right side panel 124*a*, a left side panel 124*b*, and corner panels 126 between the end panel 122 and the side panels 124*a* and 124*b*. Each end panel 122 along with the corner panels substantially spans the portion of groove 135 across the respective end of the pallet, whereas each side panel spans only a portion (preferably 55 percent) of the respective side groove. When assembled and as shown in FIGS. 7 and 10, the ends of right and left side panels 124*a* and 124*b* overlap. The overlap is preferably from about two to about four inches. End panels 122 have cutouts 125 formed in the peripheral edges thereof. Latch plates 128 corresponding to latch plates 50 of the first embodiment are mounted on one side of each cutout 125. With reference to FIG. 10, side panels 124*a* and 124*b* have cutouts 127*a* and 127*b*, respectively, formed in the peripheral edges thereof. Hook plates 175, as discussed in more detail below, are mounted adjacent cutouts 127*a* and 127*b*.

Figure 8:
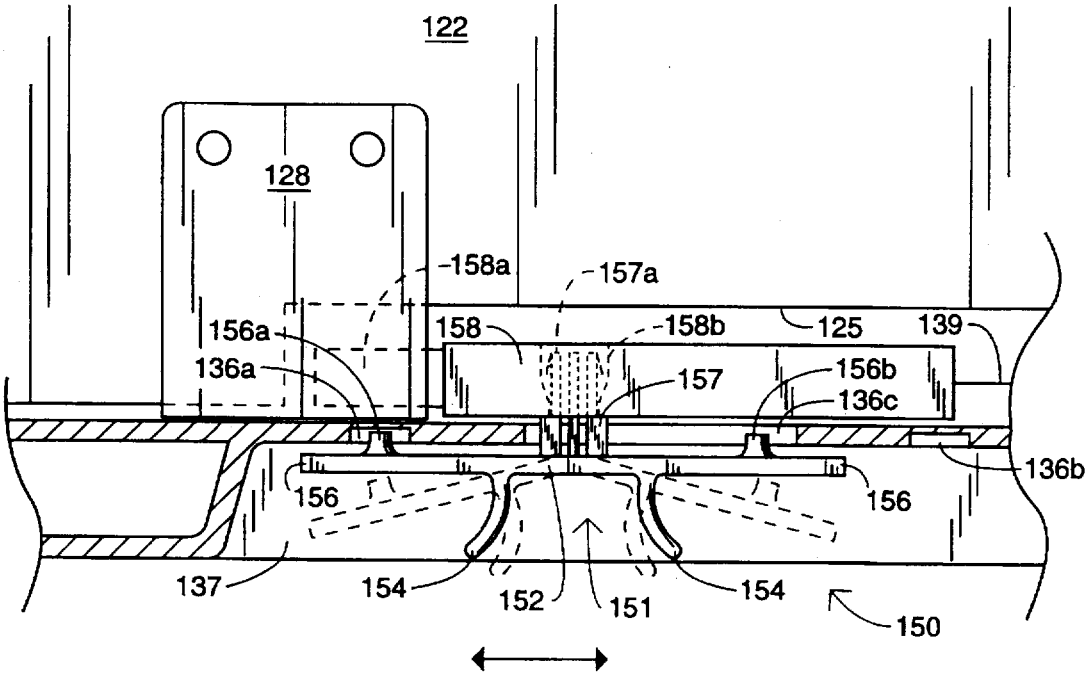
FIG. 8 is a fragmentary, front cross sectional view of the bottom pallet according to the second embodiment wherein the latch assembly is shown in the engaged position.

Turning to FIG. 8, the latch mechanism 150 is shown in detail therein. Latch mechanism 150 includes latch member 151, a portion of which is disposed in recess 137, a portion of which is disposed in groove 135, and the remainder of which is disposed in longitudinal slot 136*c* or recesses 136*a*, 136*b*. While apertures may be used in place of recesses 136*a*, 136*b*, recesses are preferred as they reduce the number of openings into the pallet system when assembled. Finger 158 extends along the length of groove 135 and includes narrowed portion 158*a*. Connector 157 is secured to and extends upwardly from base member 152 and into slot 158*b* of finger 158. More particularly, clips 157*a* of connector 157 in cooperation with slot 158*b* serve to secure finger 158 and base 156 to one another. It will be appreciated that assembly of latch member 151 is facilitated by this "snap together" connection, however, the finger and base may be assembled in any suitable manner. The shoulder of connector 157 is sized and shaped such that it may be slid along the length of slot 136*c* which parallels the length of groove 135 (i.e., leftwardly and rightwardly as indicated by the arrow). Finger 158 and base member 152 are each sized and shaped such that they may not pass through slot 136*c*. Control tabs 154 depend from base member 152. Base member 152 also includes opposed wings 156. Extensions 156*b* extend upwardly from each of wings 156. Control tabs 154 and wings 156 are biased toward the position as shown in solid lines in FIG. 8. Wings 156 may be deflected downwardly as shown in dotted lines by forcing control tabs 154 toward one another to the position as shown in dotted lines. Control tabs 154 are preferably contoured so that the user may conveniently use his or her thumb and forefinger to pull the tabs toward one another.

Latch member 151 is slidable along groove 135 between an engaged position as shown in FIG. 8, and a disengaged position (not shown). In the engaged position, narrowed portion 158*a* is disposed within latch plate 128, connector 157 is proximate the left end of slot 136*c*, extension 156*a* is disposed within recess 136*a*, and extension 156*b* is disposed within slot 136*c*. It will be appreciated that when latch member 151 is disposed in the engaged position, side wall 122 is restrained from upward movement by the interface of narrow portion 158 and latch plate 128.

In order to transition latch member 151 from the engaged position to the disengaged position, the user pulls control tabs 154 together, thereby downwardly displacing extensions 156*a* and 156*b* from aperture 136*a* and slot 136*c*. Latch member 151 is then free to slide rightwardly along groove 135 until connector 157 contacts the right end of slot 136*c*. When latch member 151 is so positioned, narrow portion 158*a* is clear of latch plate 128, thereby allowing side wall 122 to be removed upwardly from groove 135. The user may then release control tabs 154, allowing opposed wings 156 to again assume the horizontally straight position, whereupon extension 156*b* is disposed within aperture 136*b* and extension 156*a* is disposed within slot 136*c*. Latch member 151 will then be locked in the disengaged position by the interface of extension 156*b* and extension 156*a* with recess 136*b* and slot 136*c*, respectively.

When the user wishes to transition latch member 151 from the disengaged position to the engaged position, he or she need only pull control tabs 154 together again, slide latch member 151 leftwardly along groove 135 until extension 156*a* is aligned with aperture 136*a*, and release the control tabs 154.

Cut out 125 of the sidewall provides clearance for finger 158 throughout its range of motion. Notably, latch plate 128 and the side edge of cut out 125 need not be disposed sidewardly of recess 137. Rather, finger 158 may be shortened and/or latch member 151 and slot 136*c* repositioned with respect to recess 137, allowing latch plate 128 to be positioned directed over recess 137. Further, each recess 137 may be provided with a pair of latch members to engage a pair of latch plates 128. In such case, the latch plates are preferably mounted on opposite ends of the cut out (e.g., as in the first embodiment) with the latch members each assuming the engaged position by sliding away from the middle of recess 137 and one another.

In use and manufacture, the latch mechanism 150 according to the second embodiment provides certain advantages over the latch mechanism 70 according to the first embodiment. Latch member 151 is more easily assembled and mounted in latch assembly 150. Because no portion corresponding to inner wall 44 is needed, the usable space for confining packages is increased. Moreover, latch mechanism 150 is easily retrofittable to a wide range of pallet designs with minimal if any modification to the pallets.

With reference to FIG. 10, passive restraint assembly 170 is shown in greater detail therein. Passive restraint assembly 170 includes fixed bracket 180, a portion of which is disposed in groove 135. Fixed bracket 180 is secured in groove 135 by bolts or rivets 186 which extend through apertures (not shown) in bottom wall 136. Opposed extensions 182 extend from either side of fixed bracket 180 along groove 135.

Hook plates 175 are secured to side panels 128*a* and 128*b* by rivets or bolts 176 or other suitable means. Hook plates 175 correspond to latch plates 128, except that the box or chamber thereof is replaced with substantially rigid hooks 172. Hook plates 175 and fixed bracket 180 may be engaged by sliding hooks 172 sidewardly (i.e., from either side along groove 135) underneath respective extensions 182. When the lower edges of side panels 124*a* and 124*b* are disposed in groove 135 with hooks 172 disposed between extensions 182 and bottom wall 136 as shown in FIG. 10, the interface of extensions 182 and hooks 172 serves to restrain side panels 124*a* and 124*b* from upward movement. Preferably, side panels 124*a* and 124*b* overlap with cutouts 127*a* and 127*b* providing clearance for fixed bracket 180.

Figure 11:
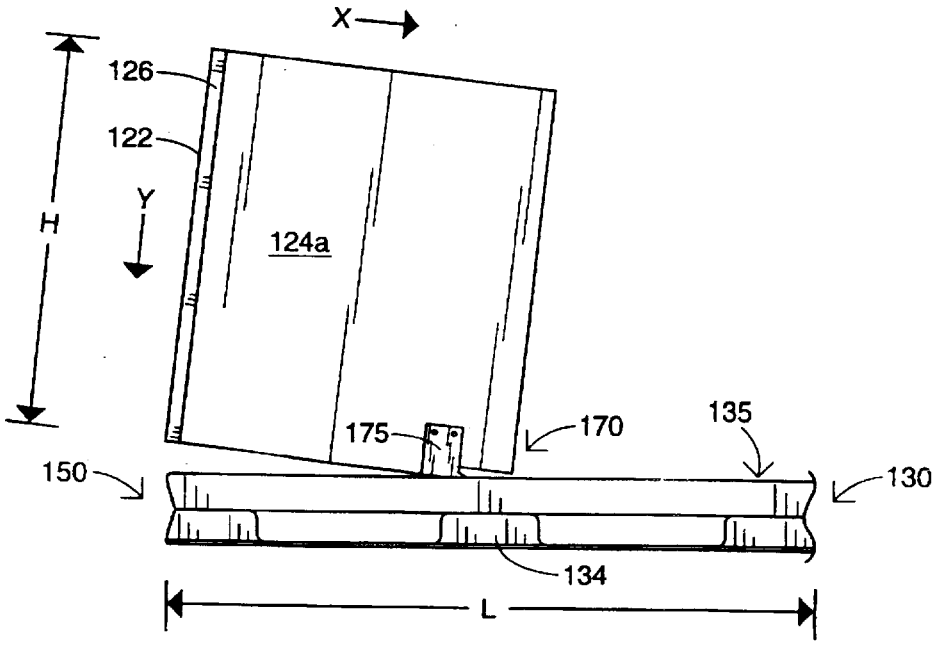
FIG. 11 is a schematic side view of a pallet according to the second embodiment and a side-wall partially installed therein.

With reference to FIG. 11, latch mechanisms 150 and passive restraint assemblies 170 may be cooperatively used to secure a side wall 120 to base pallet 130 as follows. Latch member 151 is initially placed in the disengaged position. Hooks 172 of latch plates 175 are first introduced to groove 135 by tilting side wall 120 slightly from vertical as shown and inserting the hooks into the respective grooves. Side wall 120 is then slid in the X direction along the parallel, opposed side portions of groove 135 until hooks 172 are disposed at least partly beneath extensions 182. Side wall 120 is then lowered (i.e., in the direction Y), thereby inserting the lower edge of end panel 122 into the end portion of groove 135. Once the lower edge of end panel 122 is so positioned, cutout 125 will surround finger 158 and latch plate 128 will lie in groove 135 adjacent narrow portion 158 of latch member 151. Latch member 151 is then transitioned from the disengaged position to the engaged position as discussed above.

It will be appreciated from the foregoing that, when side wall 120 is so mounted, all three of panels 122, **124*a*, and 124*b* thereof will be positively held in place with respect to the respective portions of the groove 135. When it is desired to remove side wall 120 from pallet 130**, the user need only reverse the steps as described above.

Figure 12:
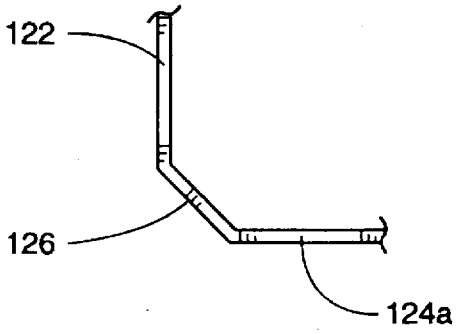
FIG. 12 is a fragmentary, schematic top plan view of the side wall of the pallet system according to the second embodiment.

With reference to FIGS. 7, 11, and 12, the provision of corner panels 126 provides several significant benefits. The configuration provides a spring or bias effect to push hook plates 175 toward fixed brackets 180. This assures that hooks 172 and extensions 182 will maintain secure engagement without requiring that the hooks and extensions be unduly large or of a shape which makes mounting and dismounting less convenient. Further, the provision of two additional corners (i.e., between panels 126 and panels **124*a* and between panels 126 and panels 122) gives the pallet system 100 greater strength to resist vertical compressive loads. Preferably, the included angle between each corner panel 126** and the adjoining end panel or side panel is 135° for each, the angle between the end and side panels being 90°.

As noted above, in order to provide a compact return package, the height of the side walls cannot exceed the lengths of the pallets. With reference to FIGS. 9 and 11, the pallet system 100 according to the second embodiment solves this problem by providing a groove 135 which has a bottom wall 136 which is raised above (i.e., with respect to the lower support surface 133) the package support surface 132 by a distance A. The top pallet may likewise have an offset groove, that is, the groove is lowered with respect to the interior support surface of the top pallet when the top pallet is positioned as shown in FIG. 7. Preferably, both the top pallet and the bottom pallet include a raised (bottom pallet) or lowered (top pallet) groove. With this provision, a side wall having a height H may be used in combination with a pallet having an interior length L which is just greater than H, while providing a distance between the upper support surface of the bottom pallet and the lower support surface of the top pallet of $H+(2\times A)$. It will be appreciated that, in this case, $H+(2\times A)$ may be greater than L. Preferably, the distance A is in the range of from about 0.5 inch to about 1 inch.

As noted above, top pallet 110 and bottom pallet 130 are preferably identical except for the provision of feet 134 on bottom pallet 130. By using the same components for both the top and bottom pallets, it is only necessary to produce or acquire tooling for a single component.

Preferably feet rails 134 are secured to bottom pallet 130 so as to be selectively detachable. In this way, when the feet are damaged, they may be conveniently and cost effectively replaced, thereby extending the overall life of the bottom pallet 130.

Figure 13:
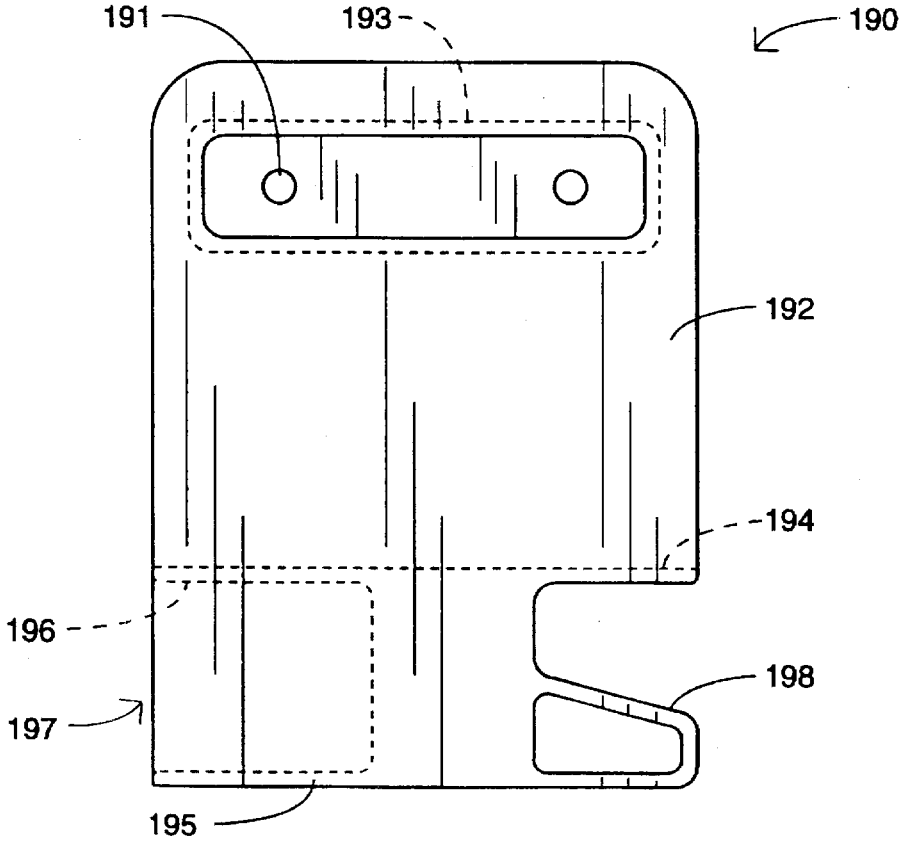
FIG. 13 is a side elevational view of a combined latch plate and hook plate.

With reference to FIG. 13, the tooling costs and inventory required to manufacture pallet systems according to the present invention may be further reduced by utilizing a combined latch and hook plate 190. Combined plate 190 includes a pair of parallel opposed walls 192 (the second is hidden by the first in FIG. 13) corresponding to inner wall 54 and outer wall 53 of latch plate 50 according to the first embodiment. A sleeve or projection 193 corresponding to projection 56 projects inwardly from each wall 192. Rivets or other suitable connectors may be inserted through holes 191 to secure plate 190 to the side wall. Walls 192 together with bottom wall 195 and top wall 194 define chamber or box 196 having opening 197. Chamber 196 is suitably sized and configured to receive finger 158 as discussed above. Hook 198 is formed extending from the lower edge of plate 190 opposite chamber 196.

Combined plate 190 may serve as either a latch plate, a hook plate, or both, as desired. To use plate 190 as a latch plate, plate 190 is mounted in a cut out in the side wall with chamber 196 opening into the cut out. To use plate 190 as a hook plate, plate 190 is mounted in the cut out with hook 198 extending into the cut out. To use plate as both a latch plate and a hook plate simultaneously, plate 190 is mounted in the cut out at a position spaced from each vertical edge of the cut out so that both the chamber and the hook are accessible.

While a preferred embodiment of the present invention has been described, it will be appreciated by those of skill in the art that certain modifications may be made without departing from the scope of the present invention. For example, stops may be formed on the facing surfaces of tabs 154 to limit the degree of deflection of wings 156. Further, it will be appreciated that the combined plate, as well as the above described latch plates and hook plates may be mounted on the edges of a side wall not having cut outs formed therein, depending on the configuration of the cooperating latch mechanisms and restraint assemblies. Latch mechanisms as described with regard to the first embodiment may be substituted for latch mechanisms 150. It will be appreciated that hooks 172 may be replaced with other suitable structures of various sizes and shapes. All such modifications are intended to come within the scope of claims which follow.

What is claimed is:

1. A pallet system comprising:

a) a side wall having a lower edge, said side wall further including a lock slot and a coupling structure each adjacent said lower edge;

b) a pallet having a peripheral rim arranged and configured to receive said lower edge;

c) a latch mechanism mounted on said pallet adjacent said peripheral rim, said latch mechanism selectively transitionable between an engaged position wherein said latch mechanism engages said lock slot thereby securing said side wall to said pallet and a disengaged position wherein said latch mechanism is not engaged with said lock slot thereby allowing said side wall to be removed from said pallet; and d) a fixed bracket fixedly mounted on said pallet adjacent said peripheral rim and spaced apart from said latch mechanism, said fixed bracket arranged and configured to receive and engage said coupling structure from a first direction and wherein, when said fixed bracket and said coupling structure are engaged, said fixed bracket restricts movement of said side wall with respect to said pallet in a second direction.

2. The pallet system of claim 1 wherein said latch mechanism includes:

a) a latch mounting member secured to an accessible portion of said peripheral rim of said pallet; and b) a latch member having a finger, said latch member slidably mounted on said latch mounting member for reciprocal movement longitudinally along said peripheral rim, wherein, when said latch mechanism is in said engaged position, said finger is engaged with said locking slot of said side wall, and, when said latch mechanism is in said non-engaged position, said finger is not engaged with said locking slot.

3. The pallet system of claim 1 wherein said latch mechanism includes:

a) a longitudinal slot formed through and along said peripheral rim;

b) a latch member including:

i) a connector extending through said longitudinal slot, said connector having a first end adjacent an upper surface of said peripheral rim and a second end adjacent a lower surface of said peripheral rim;

ii) a finger mounted on said first end of said connector; and iii) at least one control tab depending from said second end of said connector;

c) said latch member slidably mounted in said longitudinal slot for reciprocal movement along said peripheral rim; and d) wherein, when said latch mechanism is in said engaged position, said finger is engaged with said locking slot of said side wall thereby securing said side wall to said pallet, and, when said latch member is in said non-engaged position, said finger is not engaged with said locking slot thereby allowing said side wall to be removed from said pallet.

4. The pallet system of claim 3 further including:

a) a flexible base member secured to said second end of said connector, said base member selectively deflectable between a locked position and a released position by means of said tab;

b) wherein, when said base member is in said released position, said latch mechanism may be transitioned between said engaged and non-engaged positions and, when said base member is in said locked position, said latch mechanism is restricted from transition between said engaged and non-engaged positions.

5. The pallet system of claim 4 further including a second control tab depending from said second end of said connector, wherein said base member may be transitioned between said locked and released positions by moving at least one of said first and second control tabs toward the other.

6. The pallet system of claim 4 wherein said base member includes an upper surface adjacent said lower surface of said peripheral rim and an extension extending upwardly from said upper surface of said base member, wherein at least a portion of said extension is disposed within a recess formed in said peripheral rim when said latch mechanism is in said engaged position and said base member is in said locked position, and wherein said extension is not disposed in said recess when said base member is in said released position.

7. The pallet system of claim 1 wherein said coupling structure includes:

a) a substantially rigid body portion having at least one support wall with an upper portion and a lower portion, said lower portion supporting a hook;

b) a securement structure associated with said upper portion of said support wall for attaching said coupling structure to said side wall; and c) said hook spaced from and extending along said lower edge.

8. The pallet system of claim 7 wherein said lower portion includes first and second opposed ends, said hook formed on said first end of said lower portion, said coupling structure further including said lock slot defined in said second end of said lower portion and opening along said lower edge when said coupling structure is mounted on said side wall.

9. The pallet system of claim 7 wherein said peripheral rim includes a bottom wall, said fixed bracket includes a substantially rigid extension spaced from and extending along said bottom wall, and wherein, when said fixed bracket and said coupling structure are engaged, said hook is disposed between said extension of said fixed bracket and said bottom wall of said peripheral rim.

10. The pallet system of claim 9 further including a second side wall and a second coupling structure mounted on said second side wall, said second coupling structure having a second hook corresponding to said hook of said first coupling structure, said fixed bracket further including a second substantially rigid extension extending opposite said first extension of said fixed bracket and along and spaced from said bottom wall, and wherein, when said fixed bracket and said second coupling structure are engaged, said hook of said second coupling structure is disposed between said second extension of said fixed bracket and said bottom wall of said peripheral rim.

11. The pallet system of claim 1 wherein said side wall includes a first panel, a second panel, and a corner panel connecting said first and second panels, said lock slot disposed in said first panel and said coupling structure mounted on said second panel.

12. The pallet system of claim 1 further including detachable feet depending from said pallet.

13. The pallet system of claim 1 further including a second pallet detachably mounted on an upper edge of said side wall, said second pallet substantially identical to said first pallet.

14. The pallet system of claim 1 wherein said pallet further includes a support surface, and wherein said peripheral rim is formed adjacent said support surface and has a bottom wall arranged and configured to support said lower edge of said side wall, said bottom wall being raised with respect to said support surface.

15. A pallet for storing and transporting at least one package and for use in conjunction with a side wall having a lower edge and a lock slot and a coupling structure each adjacent the lower edge, said pallet comprising:

a) a peripheral rim arranged and configured to receive the lower edge of the side wall;

b) a latch mechanism mounted on said pallet adjacent said peripheral rim, said latch mechanism selectively transitionable between an engaged position wherein, when the lower edge of the side wall is mounted on said peripheral rim, said latch mechanism engages the lock slot thereby securing the side wall to said pallet and a disengaged position wherein said latch mechanism is not engaged with the lock slot thereby allowing the side wall to be removed from said pallet; and c) a fixed bracket fixedly mounted on said pallet adjacent said peripheral rim and spaced apart from said latch mechanism, said fixed bracket arranged and configured to receive and engage the coupling structure from a first direction when the lower edge is mounted on said peripheral rim and wherein, when said fixed bracket and the coupling structure are engaged, said fixed bracket restricts movement of the side wall with respect to said pallet in a second direction.

16. The pallet of claim 15 wherein said latch mechanism includes:

a) a latch mounting member secured to an accessible portion of said peripheral rim of said pallet; and b) a latch member having a finger, said latch member slidably mounted on said latch mounting member for reciprocal movement longitudinally along said peripheral rim, wherein, when said latch mechanism is in said engaged position and the lower edge is mounted on said peripheral rim, said finger is engaged with the locking slot, and, when said latch mechanism is in said non-engaged position, said finger is not engaged with the locking slot.

17. The pallet of claim 15 wherein said latch mechanism includes:

a) a longitudinal slot formed through and along said peripheral rim;

b) a latch member including:

i) a connector extending through said longitudinal slot, said connector having a first end adjacent an upper surface of said peripheral rim and a second end adjacent a lower surface of said peripheral rim;

ii) a finger mounted on said first end of said connector; and iii) at least one control tab depending from said second end of said connector;

c) said latch member slidably mounted in said longitudinal slot for reciprocal movement along said peripheral rim; and d) wherein, when said latch mechanism is in said engaged position and the lower edge is mounted on said peripheral rim, said finger is engaged with the locking slot thereby securing the side wall to said pallet, and, when said latch member is in said non-engaged position, said finger is not engaged with the locking slot thereby allowing the side wall to be removed from said pallet.

18. The pallet of claim 17 further including:

a) a flexible base member secured to said second end of said connector, said base member selectively deflectable between a locked position and a released position by means of said tab;

b) wherein, when said base member is in said released position, said latch mechanism may be transitioned between said engaged and non-engaged positions and, when said base member is in said locked position, said latch mechanism is restricted from transition between said engaged and non-engaged positions.

19. The pallet of claim 18 further including a second control tab depending from said second end of said connector, wherein said base member may be transitioned between said locked and released positions by moving at least one of said first and second control tabs toward the other.

20. The pallet of claim 18 wherein said base member includes an upper surface adjacent said lower surface of said peripheral rim and an extension extending upwardly from said upper surface of said base member, wherein at least a portion of said extension is disposed within a recess formed in said peripheral rim when said latch mechanism is in said engaged position and said base member is in said locked position, and wherein said extension is not disposed in said recess when said base member is in said released position.

21. The pallet of claim 15 wherein said peripheral rim includes a bottom wall, said fixed bracket includes a substantially rigid extension spaced from and extending along said bottom wall, and wherein, when said fixed bracket and the coupling structure are engaged, at least a portion of the coupling structure is disposed between said extension of said fixed bracket and said bottom wall of said peripheral rim.

22. The pallet of claim 15 further including detachable feet depending from said pallet.

23. The pallet of claim 15 wherein said pallet further includes a support surface, and wherein said peripheral rim is formed adjacent said support surface and has a bottom wall arranged and configured to support the lower edge of the side wall, said bottom wall being raised with respect to said support surface.

24. A latch mechanism for releasably securing a side wall of a container to a pallet, the pallet being of a type having a peripheral rim extending along a side of the pallet, the peripheral rim having an upper surface and a lower surface, a longitudinal slot formed through and along the peripheral rim, the side wall of a type including a locking slot along a lower edge, said latch mechanism comprising:

a) a latch member including:

i) a connector mountable on the pallet and having a first end and a second end, said connector arranged and configured such that, when said connector is mounted on the pallet, said connector extends through the longitudinal slot, said first end is disposed adjacent the upper surface of the peripheral rim and said second end is disposed adjacent the lower surface of the peripheral rim;

ii) a finger mounted on said first end of said connector; and iii) at least one control tab depending from said second end of said connector;

b) said latch member slidably mountable in the longitudinal slot for reciprocal movement along the peripheral rim and between an engaged position and a non-engaged position;

c) wherein, when said connector is mounted on the pallet, said latch member is slidably mounted in the longitudinal slot, the lower edge of the side wall is mounted in the peripheral rim, and said latch member is in said engaged position, said finger engages the locking slot of the side wall thereby securing the side wall to the pallet, and, when said connector is mounted on the pallet, said latch member is slidably mounted in the longitudinal slot, the lower edge of the side wall is mounted in the peripheral rim, and said latch member is in said non-engaged position, said finger does not engage the locking slot thereby allowing the side wall to be removed from the pallet;

d) a flexible base member secured to said second end, said base member selectively deflectable between a locked position and a released position by means of said tab; and e) wherein, when said base member is in said released position, said latch member may be transitioned between said engaged and non-engaged positions and, when said base member is in said locked position, said latch member is restricted from transition between said engaged and non-engaged positions.

25. The latch mechanism of claim 24 further including a second control tab depending from said second end, wherein said base member may be transitioned between said locked and released positions by moving at least one of said first and second control tabs toward the other.

26. The latch mechanism of claim 24 wherein said base member includes an upper surface and an extension, said upper surface disposed adjacent the lower surface of the peripheral rim when said latch member is mounted on the pallet and said extension extending upwardly from said upper surface of said base member, wherein at least a portion of said extension is disposed within a recess formed in the peripheral rim when said latch member is mounted on the pallet and is in said engaged position and said base member is in said locked position, and wherein said extension is not disposed in the recess when said latch member is mounted on the pallet and said base member is in said released position.

27. A coupling structure for securing a side wall having a lower edge to a pallet, said coupling structure comprising:

a) a substantially rigid body portion having at least one support wall with an upper portion and a lower portion, said lower portion supporting a hook;

b) a securement structure attached to said upper portion of said support wall for attaching said hook structure to the side wall;

c) said hook spaced from and extending along the lower edge when said hook structure is mounted on the side wall; and d) wherein said lower portion includes first and second opposed ends, said hook formed on said first end, said coupling structure further including a chamber defined in said second end and opening along the lower edge when said coupling structure is mounted on the side wall, whereby said chamber may receive a latch member when the side wall is mounted on the pallet.

28. A pallet system comprising:

a) a side wall having a lower edge, said side wall further including a lock slot and a coupling structure each adjacent said lower edge, said coupling structure including:

i) a substantially rigid body portion having at least one support wall with an upper portion and a lower portion, said lower portion supporting a hook;

ii) a securement structure associated with said upper portion of said support wall for attaching said coupling structure to said side wall; and iii) said hook spaced from and extending along said lower edge;

b) a pallet having a peripheral rim arranged and configured to receive said lower edge, said peripheral rim including a bottom wall;

c) a latch mechanism mounted on said pallet adjacent said peripheral rim, said latch mechanism selectively transitionable between an engaged position wherein said latch mechanism engages said lock slot thereby securing said side wall to said pallet and a disengaged position wherein said latch mechanism is not engaged with said lock slot thereby allowing said side wall to be removed from said pallet, said latch mechanism including:

i) a longitudinal slot formed through and along said peripheral rim;

ii) a latch member including:

a) a connector extending through said longitudinal slot, said connector having a first end adjacent an upper surface of said peripheral rim and a second end adjacent a lower surface of said peripheral rim;

b) a finger mounted on said first end of said connector; and c) at least one control tab depending from said second end of said connector;

iii) said latch member slidably mounted in said longitudinal slot for reciprocal movement along said peripheral rim; and iv) wherein, when said latch mechanism is in said engaged position, said finger is engaged with said locking slot of said side wall thereby securing said side wall to said pallet, and, when said latch member is in said non-engaged position, said finger is not engaged with said locking slot thereby allowing said side wall to be removed from said pallet; and d) a fixed bracket fixedly mounted on said pallet adjacent said peripheral rim and spaced apart from said latch mechanism, said fixed bracket including a substantially rigid extension spaced from and extending along said bottom wall, said fixed bracket arranged and configured to receive and engage said coupling structure from a first direction and wherein, when said fixed bracket and said coupling structure are engaged, said hook is disposed between said extension of said fixed bracket and said bottom wall of said peripheral rim thereby restricting movement of said side wall with respect to said pallet in a second direction.

29. The pallet system of claim 28 further including:

a) a flexible base member secured to said second end of said connector, said base member selectively deflectable between a locked position and a released position by means of said tab;

b) wherein, when said base member is in said released position, said latch mechanism may be transitioned between said engaged and non-engaged positions and, when said base member is in said locked position, said latch mechanism is restricted from transition between said engaged and non-engaged positions.

30. The pallet system of claim 28 further including a second control tab depending from said second end of said connector, wherein said base member may be transitioned between said locked and released positions by moving at least one of said first and second control tabs toward the other.

31. The pallet system of claim 28 wherein said base member includes an upper surface adjacent said lower surface of said peripheral rim and an extension extending upwardly from said upper surface of said base member, wherein at least a portion of said extension of said base member is disposed within a recess formed in said peripheral rim when said latch mechanism is in said engaged position and said base member is in said locked position, and wherein said extension of said base member is not disposed in said recess when said base member is in said released position.

32. The pallet system of claim 28 wherein said lower portion of said coupling structure includes first and second opposed ends, said hook formed on said first end of said lower portion, said coupling structure further including said lock slot defined in said second end of said lower portion and opening along said lower edge when said coupling structure is mounted on said side wall.

33. The pallet system of claim 22 further including a second side wall and a second coupling structure mounted on said second side wall, said second coupling structure having a second hook corresponding to the hook of the first coupling structure, said fixed bracket further including a second substantially rigid extension extending opposite said first extension of said fixed bracket and along and spaced from said bottom wall, and wherein, when said fixed bracket and said second coupling structure are engaged, said hook of said second coupling structure is disposed between said second extension of said fixed bracket and said bottom wall of said peripheral rim.

34. The pallet system of claim 28 wherein said side wall includes a first panel, a second panel, and a corner panel connecting said first and second panels, said lock slot disposed in said first panel and said coupling structure mounted on said second panel.

35. The pallet system of claim 28 further including detachable feet depending from said pallet.

36. The pallet system of claim 28 further including a second pallet detachably mounted on an upper edge of said side wall, said second pallet substantially identical to said first pallet.

37. The pallet system of claim 28 wherein said pallet further includes a support surface, and wherein said peripheral rim is formed adjacent said support surface and has a bottom wall arranged and configured to support said lower edge of said side wall, said bottom wall being raised with respect to said support surface.

38. A side wall comprising:

a) a lower edge; and b) a lock slot and a coupling structure each adjacent said lower edge, said coupling structure including:

i) a substantially rigid body portion having at least one support wall with an upper portion and a lower portion, said lower portion supporting a hook;

ii) a securement structure attached to with said upper portion of said support wall for attaching said coupling structure to said side wall; and iii) said hook spaced from and extending along said lower edge.

39. The side wall of claim 38 wherein said side wall includes a first panel, a second panel, and a corner panel connecting said first and second panels, said lock slot disposed in said first panel and said coupling structure mounted on said second panel.

40. A pallet for storing and transporting at least one package and for use in conjunction with a side wall having a lower edge and a coupling structure adjacent the lower edge, said pallet comprising:

a) a peripheral rim arranged and configured to receive the lower edge of the side wall; and b) a fixed bracket fixedly mounted on said pallet adjacent said peripheral rim, said fixed bracket arranged and configured to receive and engage the coupling structure from a first direction when the lower edge is mounted on said peripheral rim and wherein, when said fixed bracket and the coupling structure are engaged, said fixed bracket restricts movement of the side wall with respect to said pallet in a second direction.

41. The pallet of claim 40 wherein said peripheral rim includes a bottom wall, said fixed bracket includes a substantially rigid extension spaced from and extending along said bottom wall, and wherein, when said fixed bracket and the coupling structure are engaged, at least a portion of the coupling structure is disposed between said extension of said fixed bracket and said bottom wall of said peripheral rim.

42. A fixed bracket for use in conjunction with a pallet and a side wall having a lower edge and a coupling structure each adjacent the lower edge, the pallet including a peripheral rim arranged and configured to receive the lower edge of the side wall, said fixed bracket mounted on the pallet adjacent the peripheral rim and arranged and configured to receive and engage the coupling structure from a first direction when the lower edge is mounted on the peripheral rim and wherein, when said fixed bracket and the coupling structure are engaged, said fixed bracket restricts movement of the side wall with respect to the pallet in a second direction.

43. The pallet of claim 42 wherein the peripheral rim includes a bottom wall, said fixed bracket includes a substantially rigid extension spaced from and extending along the bottom wall, and wherein, when said fixed bracket and the coupling structure are engaged, at least a portion of the coupling structure is disposed between said extension of said fixed bracket and the bottom wall of the peripheral rim.

* * * * *